United States Patent [19]

Klaus

[11] 4,145,100

[45] Mar. 20, 1979

[54] SIDE TAB FILE

[75] Inventor: Gerald R. Klaus, St. Charles, Ill.

[73] Assignee: Fellowes Manufacturing Company, Itasca, Ill.

[21] Appl. No.: 858,670

[22] Filed: Dec. 8, 1977

[51] Int. Cl.[2] ..... A47B 43/02; A47B 63/06

[52] U.S. Cl. ..... 312/261; 211/11; 211/42; 229/30; 312/183; 312/10

[58] Field of Search ..... 312/294, 259, 330 R, 312/233, 188, 183, 261, 9, 10; 229/DIG. 1, 30; 211/11, 40, 42, 126

[56] References Cited

U.S. PATENT DOCUMENTS

| | | | |
|---|---|---|---|
| 887,631 | 5/1908 | Hawthorne | 312/10 |
| 1,133,889 | 3/1915 | Smith | 312/330 |
| 1,953,418 | 4/1934 | MacDonald | 206/45 |
| 1,982,663 | 12/1934 | Hoffmaster | 206/45 |
| 3,638,800 | 2/1972 | Frederick et al. | 312/9 |
| 3,666,337 | 5/1972 | Sztorc | 312/330 |

FOREIGN PATENT DOCUMENTS

| | | | |
|---|---|---|---|
| 646427 | 6/1937 | Fed. Rep. of Germany | 211/42 |

*Primary Examiner*—Mervin Stein
*Assistant Examiner*—Alex Grosz
*Attorney, Agent, or Firm*—Roy E. Hofer; Joan I. Norek

[57] ABSTRACT

There is provided a compartment for storage of side-tabbed file or the like which includes a cabinet which receives at least one reversible, open-ended file tray. The tray can be positioned in an open condition for easy access to the files stored within or in a closed condition for dust free storage. When stored, open, the tabs of the files extend outwardly of the compartment for simple observation. When stored closed, a restraining means is provided to avoid file movement through the open-end.

32 Claims, 14 Drawing Figures

FIG. 1
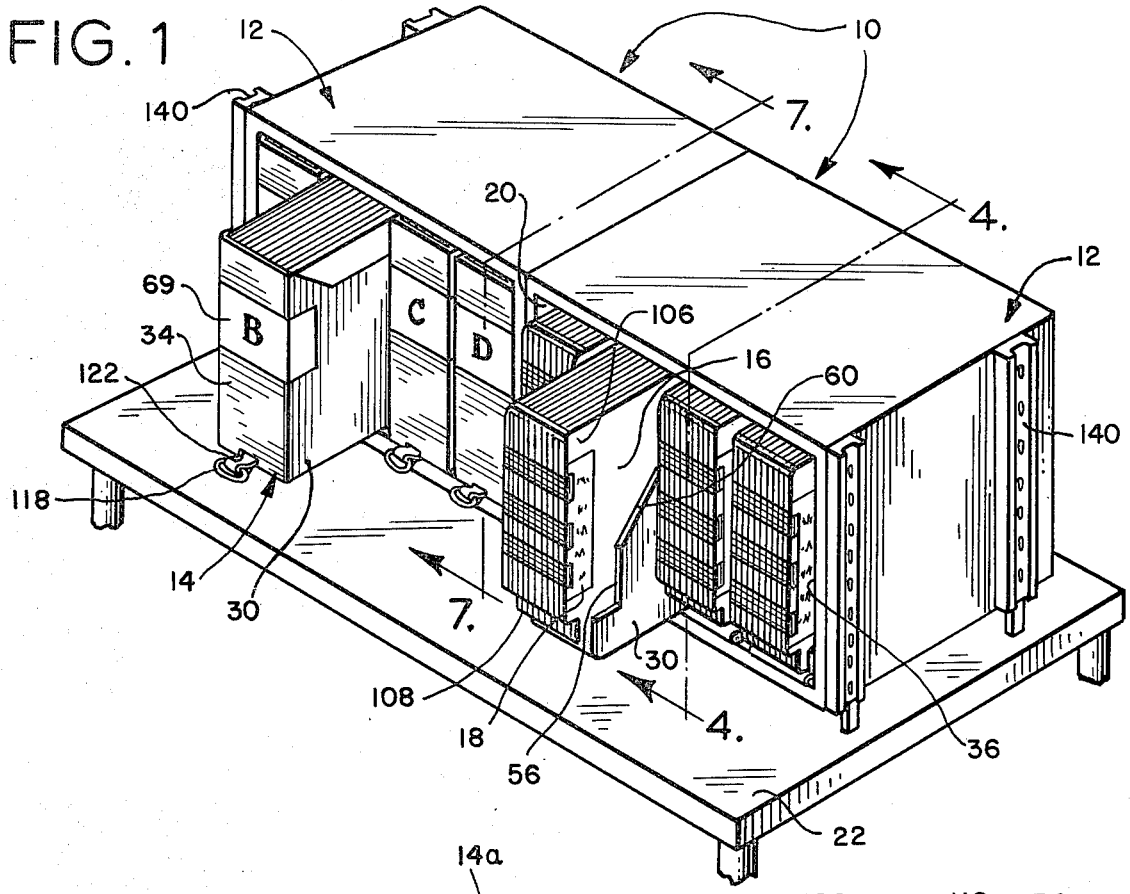
FIG. 2
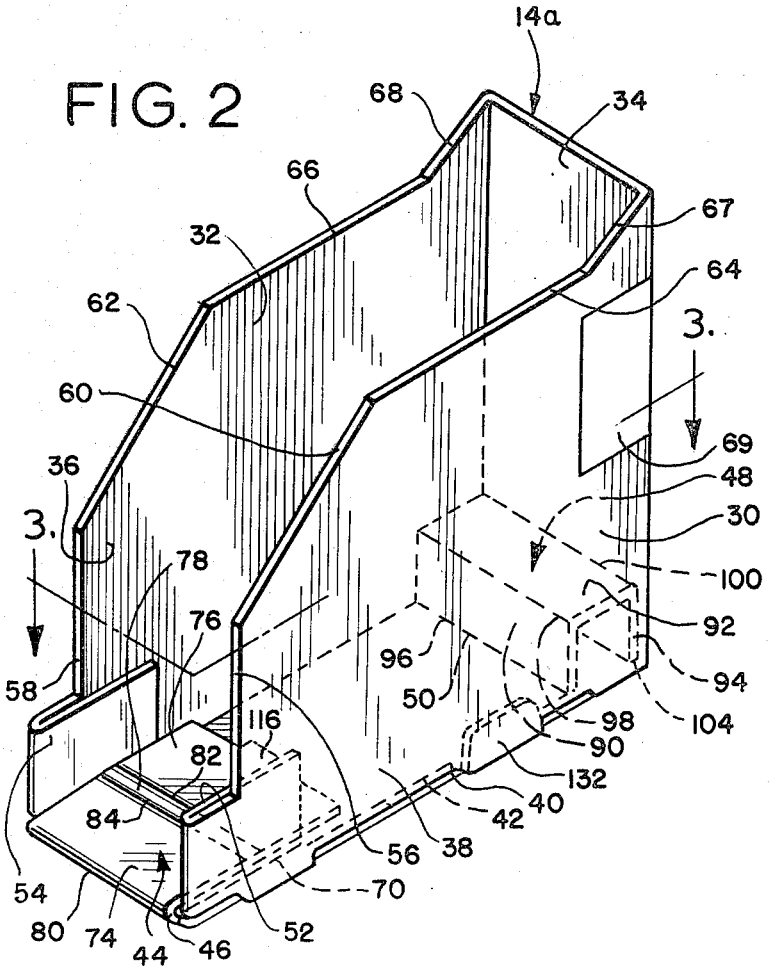
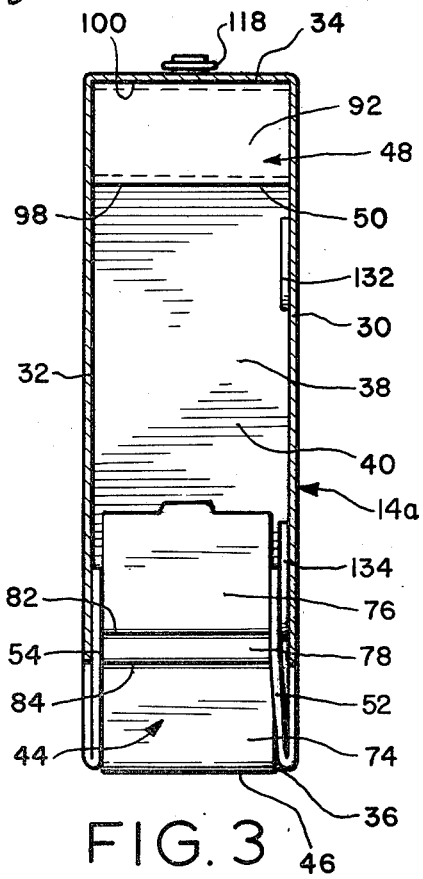
FIG. 3

FIG. 9
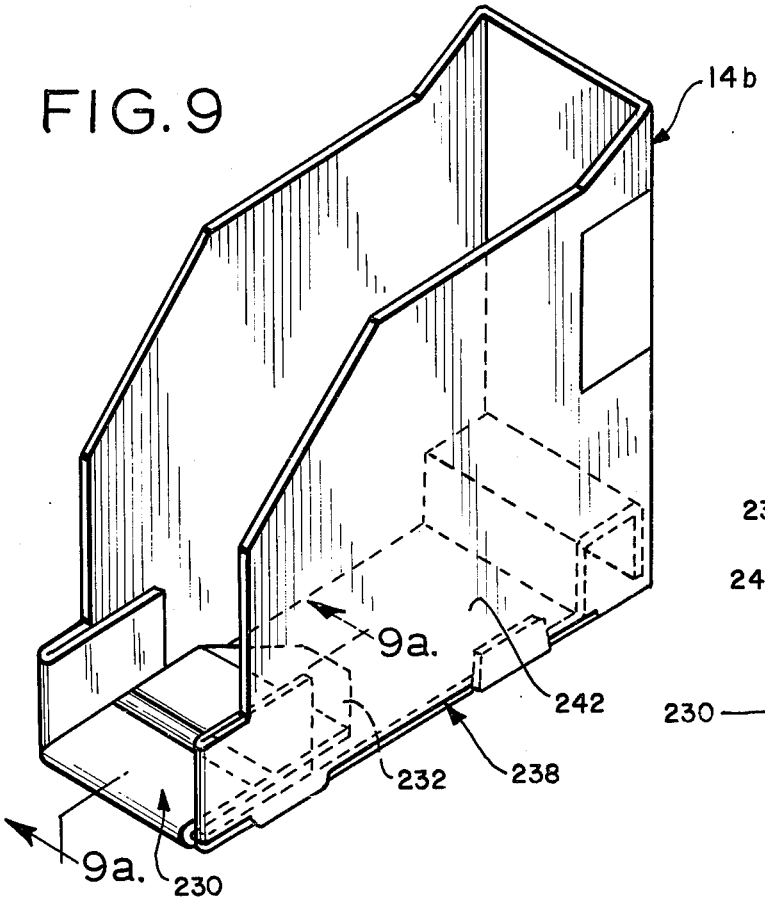
FIG. 10
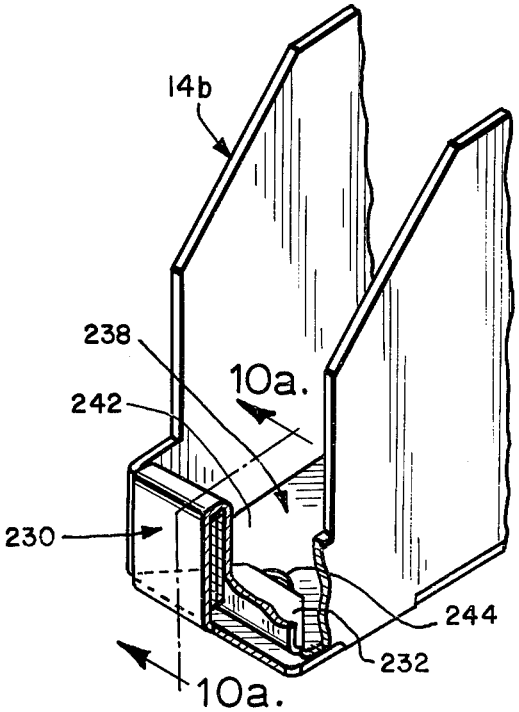
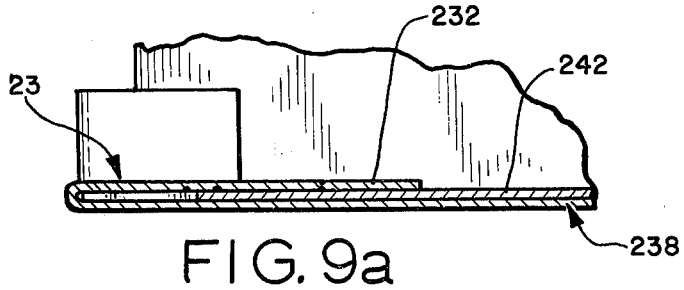
FIG. 9a
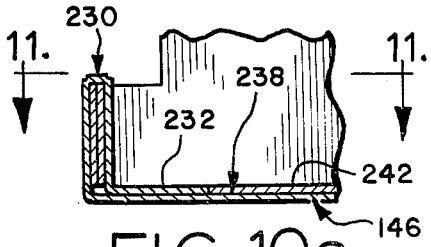
FIG. 10a
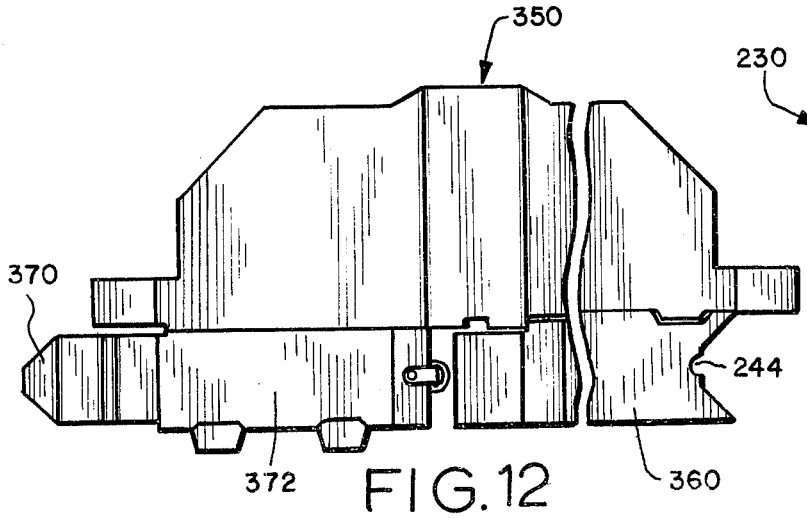
FIG. 12
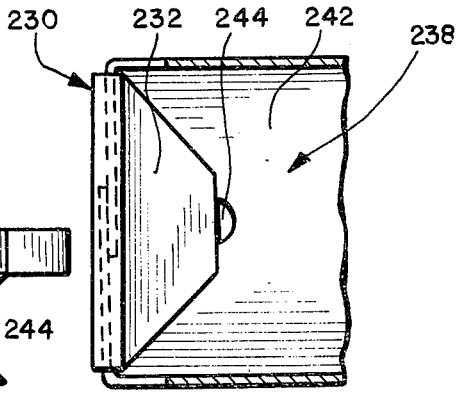
FIG. 11

SIDE TAB FILE

BACKGROUND OF THE INVENTION

The present invention is directed toward an improved filing compartment for storage of side-tabbed files, which compartment includes reversible file trays for storage of the files in either an open or closed condition.

Use of side-tabbed files is advantageous, reducing the amount of space necessary for storage. No storage space beyond the volume of the files themselves is required when the files are stored in an open-ended compartment.

Files which are tabbed along their top edge require an open space above for viewing, when separate compartments are aligned one above the other, or, alternatively, require the compartments themselves to be slideable outward. If space is allowed for viewing top tabs from above, the amount of additional storage space is considerable. If the compartment is constructed so as to slide outwardly, its construction requires sturdy, expensive materials and complicated assembling, which are often unduly expensive and result in compartments which are difficult to move and assemble.

It is often advantageous to store files in compartments made of light weight material, such as corrugated fiberboard. Such compartments can be made collapsible for easy shipment and storage. The compartments and trays preferably should be simple to assemble into their functional positions and then be sufficiently rigid and of such integrity so as to withstand the normal wear and tear. Fiberboard compartments and trays are relatively inexpensive, as compared to those constructed of metal or wood or other rigid material. Corrugated fiberboard trays, however, generally are not adaptable to assemblies which require the individual trays to slide outwardly from the compartments. Corrugated fiberboard storage trays can, however, be advantageously used for storage of side-tabbed files in open-ended compartments, in which the tabs can easily be observed at the side, eliminating the need for overhead space.

It is desirable to provide an open-ended compartment for storing side-tabbed files so that the side tabs can be readily observed. It is also desirable to provide a filing compartment for side-tabbed files which allows files, not in current use, to be stored in a closed condition, avoiding accumulation of dust. It is therefore desirable to provide such a storage compartment wherein the files can be stored either open or closed, as desired. Cabinets with reversible trays for storage of tape cassettes in either an open or closed position are known in the art. For example, the cabinet disclosed in U.S. Pat. No. 3,666,337 has trays which recline backward to prevent accidental dislodgement of the cartridges which cartridges extend beyond the tray to allow removal by hand. This cabinet and tray design would not be suitable for a collapsible compartment of corrugated fiberboard or the like which would be subject to excessive wear if disposed in a backwardly reclining position. Moreover, if the stored files extend beyond the trays, the files would be subject to damage, particularly when stored in a closed condition.

It is also desirable to restrain any file movement out of the open-end of a storage tray when stored in a closed condition, during which time the tray may be pulled out or pushed into the compartment. It is also desirable to provide a tray which allows the files to be easily removed when desired and positions the side files outwardly of the tray and compartment, to facilitate viewing of the tabs.

It is also desirable to provide a corrugated fiberboard compartment which may be easily assembled into a sufficiently strong structure and yet may be easily disassembled so that full advantage of the mode of construction may be realized.

The general object of the invention is to provide a storage compartment for side-tabbed files or the like which includes reversible file trays, for storing files in either an open or a dust free closed condition. It is also an object to provide a filing compartment construction which does not require rigid materials and can be of lightweight material, such as corrugated fiberboard. It is an object to provide a compartment with trays wherein stored files are restrained from movement outward when disposed in the closed condition. It is a further object to provide a compartment wherein the file tabs extend beyond the open-end of the tray when disposed in the open condition, to display the tabs and the information contained thereon. It is also an object to provide storage compartments that can easily be stacked one above another or side-by-side while not requiring space in excess of the volume of the files and the dimensions of the compartment itself. Another object is to provide collapsible trays and a blank therefor which does not require conventional means for securing its components together, such as staples or screws, which would perforate a tray, weakening its structure.

SUMMARY OF THE INVENTION

These and other objects are accomplished by the present invention which provides a file compartment including an open-ended cabinet which receives at least one reversible file tray, with one closed end wall opposite an open-end, for storage of files in either a closed or open condition. When a tray is inserted into a cabinet with its closed end wall facing outward, the files are stored in a substantially dust free environment. By reversing the tray, convenient access to files is provided by the open-end. The tray may include a means for restraining the files from movement outward of the open-end, which restraining means is removable to facilitate access to the files when stored in the open condition. The tray may also include a means for positioning the files forward of the end wall so that the file tabs extend beyond the compartment and tray and can be observed with ease.

The construction of the cabinet and trays is suitable for lightweight material such as corrugated fiberboard. The trays are designed for disassembly into a compact form for convenient shipment or storage when not in use.

The present invention also provides a blank which can be assembled into a reversible tray with a file restraining means and a means for positioning the file tabs outwardly of the tray. The blank can be assembled into a tray without the use of tools or conventional securing means such as staples, bolts, clips, or the like, and yet the tray is sufficiently rigid and durable for normal use.

The invention and the advantages provided thereby may be more fully understood with reference to the following drawings and detailed description.

DESCRIPTION OF THE DRAWINGS

FIG. 1 is a perspective view of two file compartments embodying features of the present invention;

FIG. 2 is a perspective view of a file tray of a file compartment of FIG. 1 embodying features of the present invention and shown in position for open storage;

FIG. 3 is a cross-sectional top view of the file tray of FIG. 2 taken along lines 3—3 of FIG. 2;

FIG. 9 is a perspective view of a file tray of a file compartment of FIG. 1, embodying features of the present invention and shown in position for open storage;

FIG. 9*a* is a cross-sectional, sectional side view of the file tray of FIG. 9, taken along line 9*a* of FIG. 9;

FIG. 10 is a sectional, partially cutaway perspective view of the file tray of FIG. 9 shown in position for closed storage;

FIG. 10*a* is a cross-sectional, sectional side view of the file tray of FIG. 10, taken along line 10*a* of FIG. 10;

FIG. 11 is a cross-sectional, sectional top view of the file tray of FIG. 10, taken along line 11 of FIG. 10*a;* and FIG. 12 is a top plan view of a blank for assembling a file tray of FIG. 9 embodying features of the present invention.

DETAILED DESCRIPTION OF THE INVENTION

Figure 4:
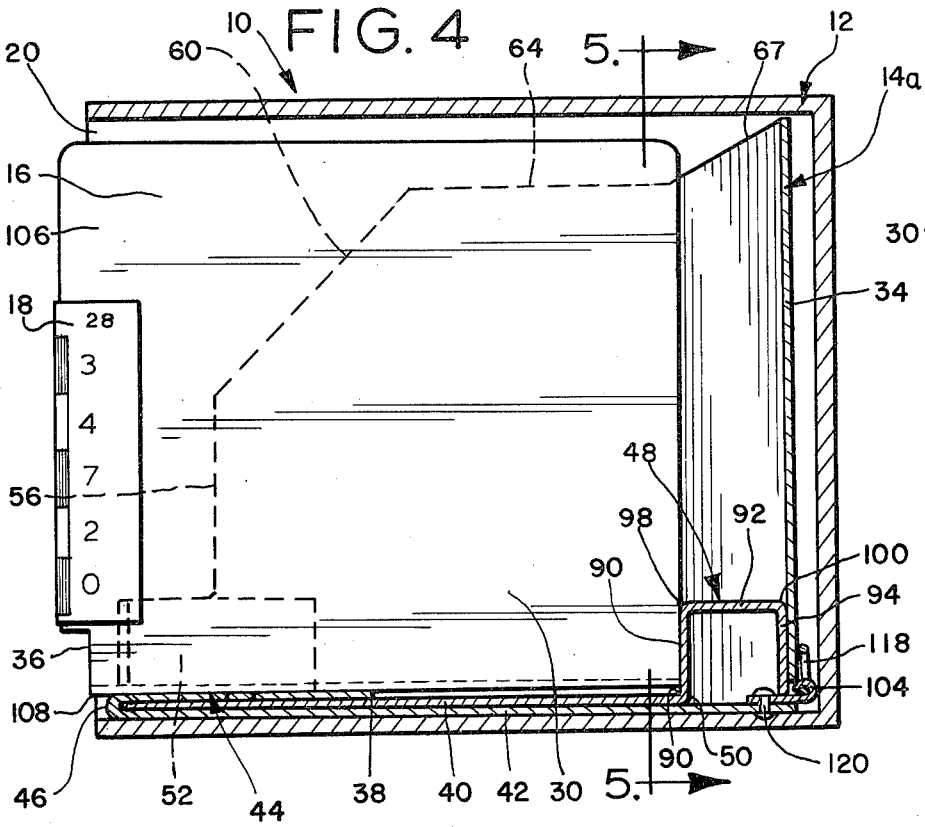
FIG. 4 is a cross-sectional side view of a file compartment of FIG. 1 taken along lines 4—4 of FIG. 1.

Referring now to the drawings and particularly to FIG. 1, there are illustrated two filing compartments embodying features of the present invention, indicated generally by reference numeral 10. The two compartments 10 are illustrated positioned side-by-side and each includes a shell or cabinet, designated generally by reference numeral 12, and a plurality of file trays designated generally by reference numeral 14. The trays 14 each hold a plurality of files 16, which files 16 have side tabs 18. The trays 14 are shown inserted into an open-end 20 of each of the cabinets 12 in an open position (compartment 10 on the right) or in a closed position (compartment 10 on the left). When the files 16 are stored open, the side tabs 18 can be viewed and the files 16 can be removed from the trays 14 with ease. When the files 16 are stored closed, the trays 14 fit snugly within the cabinet 12 and totally enclose its open-end 20, providing dust free storage. The compartment 10 may be placed on any convenient shelf or supporting surface such as a table 22 as illustrated.

The invention includes cabinets 12 with file trays 14 with either or both preferred forms of means for restraining stored files as illustrated respectively in FIGS. 2 to 7 and FIGS. 9 to 11. To clarify which embodiment is being discussed, the trays 14 are designated either 14*a* or 14*b* in the following detailed description and in FIGS. 2 to 7 and 9 to 11, although features of the trays 14 that are identical are designated with the same reference numerals in both embodiments.

Referring now to FIGS. 2 and 3 also, the file tray 14*a* includes two opposed side walls 30, 32, an end wall 34, an open-end 36 opposite the end wall 34, and a bottom wall 38. The bottom wall is illustrated as composed of two layers, an upper layer 40 and a lower layer 42. The lower layer 42 extends from the open-end 36 to the end wall 34 while the upper layer 40 ends a distance away from the end wall 34. Both layers 40 and 42 are illustrated as including extensions along one of each of their edges, as a first flap 44, an extension of edge 46 of lower layer 42 adjacent the open-end 36 of the tray 14*a*, and a second flap 48 along an dge 50 of upper layer 40 adjacent the end wall 34 of the tray 14a. The two flaps 44, 48 function respectively as a means for restraining the files 16 and a means for positioning the files 16 forward of the end wall 34 as will be explained in more detail below. The flaps 44, 48 need not be formed as extensions of bottom wall layers 42, 40 and could be secured to the trays 14a by other means, the selection of which is within the ordinary skill of one in the art. Forming the flaps 44, 48 as extensions of the bottom wall layers 42, 40 is however a preferred embodiment of the invention, the advantages of which will be described more fully below.

The trays 14*a* also include a first and a second side tab 52, 54 which are extensions of the first and second side walls 30,32, respectively. These tabs 52, 54 are closely adjacent the bottom wall 38 and their functions will be described in detail below.

The opposed side walls 30, 32 are shown partially cutaway to allow observation of the side tabs 18 and handling of the files 16 with ease. For example, the side walls 30, 32 are shown cutaway to provide edges 56, 58, which edges 56, 58 are recessed from the open-end 36 of the trays 14*a* from the top of the trays 14*a* to the tops of tabs 52, 54 to expose the side tabs 18 of the files 16. The corners of the side walls 30, 32 adjacent the open-end 36 are cutaway to diagonal edges 60, 62 to provide access to the corners of the stored files 16 in handling. The top of the side walls 30, 32 are cutaway in part to provide recessed edges 64, 66 to expose a top portion of the files 16 stored within, also for ease in handling the files 16. Two other diagonal edges 67, 68 extend from the side walls 32, 34 respectively to the top of the end wall 34 of the tray 14*a* in order to maintain the rigidity of the end wall 34. The file tray 14*a* may also include a label 69 on the outside of the end wall 34 which may preferably extend around the end wall 34 to the side walls 30, 32.

The trays 14*a*, particularly as illustrated in FIGS. 2 and 3 and the right hand portion of FIG. 1, are shown assembled for open storage of the files 16. The first flap 44 lies flat against the upper layer 40 of the bottom wall 38 and therefore underlies the stored files 16 and, in this position, is essentially non-functional. The tabs 52, 54, extensions of the side walls 30, 32, are folded against the inner surface of the side walls 30, 32 and each tab 52, 54 has a bottom edge 70, 72 in close proximity to, if not touching, the upper layer 40 of the bottom wall 38. Since the first flap 44 overlies the bottom wall's upper layer 40, and is not of insignificant depth, it will frictionally engage tabs 52, 54 and maintain their position adjacent the side walls 30, 32 respectively. The first flap 44 itself has a first and second panel 74, 76 secured together by a first hinged connection 78 and the first panel 74 is interconnected to the lower layer 42 of the bottom wall 38 by a second hinged connection 80 along the forward edge 46 of the lower layer 42. The second hinged connection 80 is illustrated as a crease or fold while the first hinged connection 78 is formed from two folds 82, 84 and an extent therebetween at least sufficient to accommodate and sandwich the two tabs 52, 54 between the panels 74,76. The function of this mode of construction will be explained at more detail below.

The second flap 48, the extension of the upper layer 40 of the bottom wall 38, is likewise formed of panels, a first, a second, and a third panel 90, 92, 94. the first panel 90 is hingedly connected to the upper layer 40 by means of a crease or fold 96 along its edge 50. The first panel 90 is connected to the second panel 92 by a hinged connection or fold 98 and likewise the second panel 92 is connected to the third panel 94 by a fold 100, leaving an edge 104 of third panel 94 free. The second flap 48, positioned as illustrated in FIGS. 2 and 3, forms a means for positioning stored files 16 forward from the end wall 34. The flap 48 is formed into a step-like structure wherein the first and third panel 90, 94 are positioned substantially perpendicular to the bottom of wall 38 while the second panel 92 is disposed above and substantially parallel to the bottom wall 38. The third panel 94 is positioned against inner surface of the end wall 34 and its free edge 104 frictionally engages the bottom wall 38 to form a substantially rigid step-like structure. That is, the substantial abutment of the third panel 94 with the end wall 34 and the frictional engagement of its free edge 104 with the bottom wall 38 preventing this third panel 94 from folding under the second panel 92. The hinges 96 and 98 are preferably partially perforated and yet are sufficiently stiff to keep the second panel 92 from folding over onto the first panel 90. Additionally, the width of at least one of the panels 90, 92, 94, preferably that of the first panel 90, is sufficient to contact and frictionally engage the side walls 30, 32. Allowing the other panels 92, 94 to be of less width facilitates movement of this second flap 48 when desired. The step-like structure positions stored files sufficiently forward of the end wall 34, so that a portion of such files, particularly its tabs 18, extend beyond the open-end 36 of the tray 14*a* to better expose the tabs 18 to observation and to facilitate handling of such files when stored in the open position.

Figure 5:
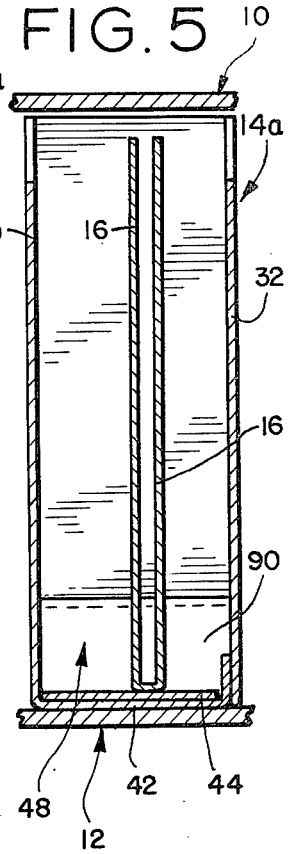
FIG. 5 is a cross-sectional end view of a file cabinet of FIG. 1 taken along lines 5—5 of FIG. 4.

Referring now to FIGS. 4 and 5 also, files 16 are shown stored with an extension 106 protruding beyond the tray 14*a* which extension 106 begins a distance above the bottom edge 108 of the file 16. Each file 16 abuts the flap 48, in its functional steplike position, and therefore each is positioned a distance away from the end wall 34. Observation of the tabs 18 is not hindered by the side walls 30, 32 of tray 14*a*. The files 16 overlie the first flap 44, which flap 44 is positioned against the upper layer 40 of the bottom wall 38. The weight of the files 16 will facilitate maintaining the first flap 44 in this nonfunctional position.

Figure 6:
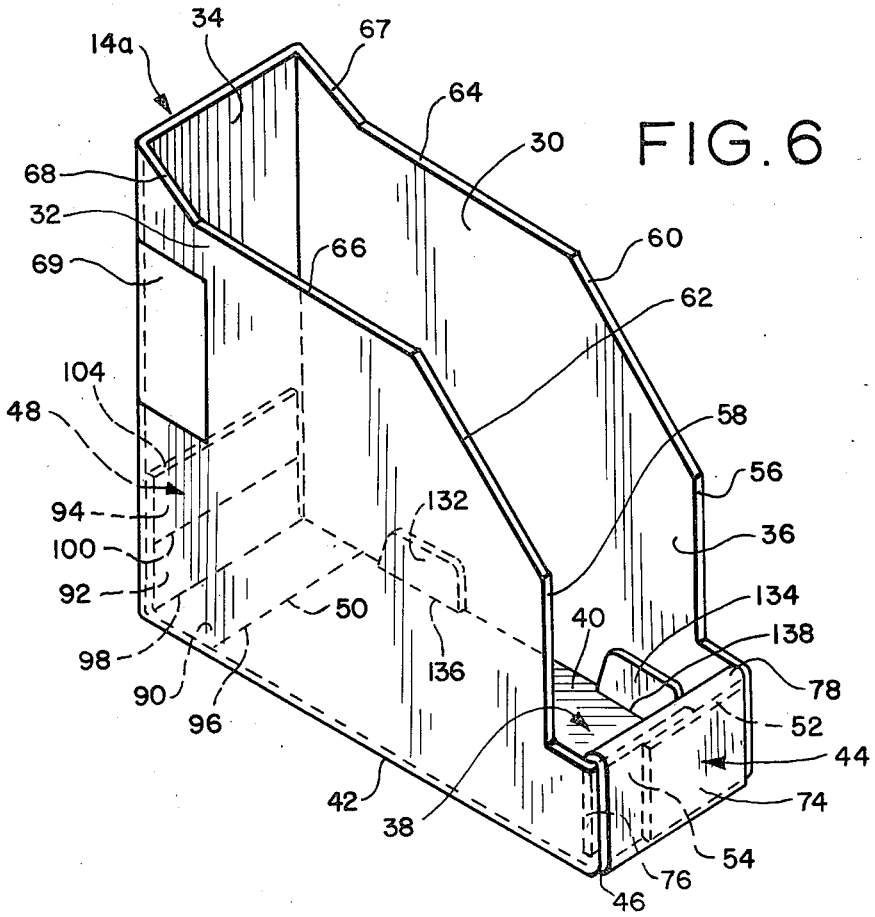
FIG. 6 is a perspective view of the file tray of FIG. 2 embodying features of the present invention and shown in its position for closed storage.
Figure 7:
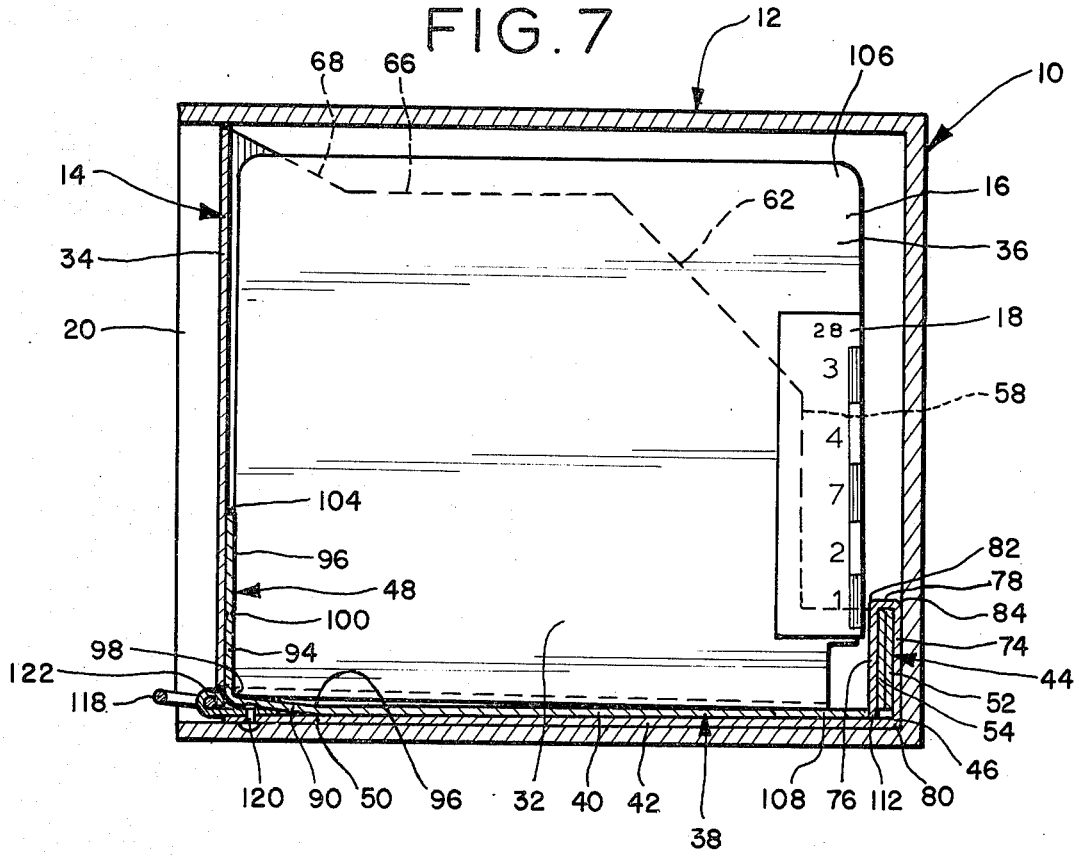
FIG. 7 is a cross-sectional side view of a file compartment of FIG. 1 taken along lines 7—7 of FIG. 1.

Referring now to FIGS. 6 and 7, there is illustrated a tray 14*a* and cabinet 12 wherein the tray 14*a* is assembled for closed storage. The second flap 48 is functionally positioned, i.e., the first panel 90 overlies the bottom wall 38 and forms an extension of the bottom wall's upper layer 40, to the end wall 34. The second and third panels 92, 94 lie flat against the end wall 34. The second flap 48 is essentially nonfunctional The first flap 44 is assembled into its functional position, away from the bottom wall 38. The tabs 52, 54 extending from the side walls 30, 32, extend towards each other, partially overlapping. The first flap 44 extends about the tabs 52, 54, sandwiching them between its two panels 74, 76. The hinged connection 78 extends over the top of the tabs 52, 54. The bottom wall 38 has a slot 112 adjacent the tray's open end 36 which slot 112 can be formed by a cutaway portion in the upper layer 40 and the adjacent portion of panel 74. The free edge of panel 76 preferably has a tab extension 116 which extends into the slot 112 to lock the flap 44 in its upright position. The upright flap 44 forms a file restraining means. The stored files 16 are thereby restrained from movement outward of the open-end 36, for instance when the tray 14*a* is inserted or removed from the cabinet 12 or carried around by hand.

To facilitate removing the trays 14*a* from the cabinet 12, once stored in the closed position, a pull or ring 118 is provided on the outer surface of the end wall 45. This ring 118 can be secured to the lower layer 42 of the bottom wall 38 by any conventional means such as a rivet 120. The ring 118 protrudes through an opening 122 in the end wall 34.

The tray 14*a* also includes a first and a second bottom tab 132, 134, which are extensions of a side of the lower layer 42 of the bottom wall 38. The tabs 132, 134 protrude through a first and a second side slot 136, 138, respectively, in the upper layer 40 of the bottom wall 38, adjacent the first side wall 30. The bottom tabs 132, 134 maintain the integrity of the bottom wall 38 in a construction wherein the upper layer 40 is formed as an extension the first side wall 30, the lower layer 42 is formed as an extension of the second side wall 32, and the two layers 40, 42 overlap to form the bottom wall 38. This is the preferred mode of construction of the tray 14*a*.

The compartments 10 may also include stacking means 140 as illustrated in FIG. 1, such as the stacking racks described in U.S. Pat. No. 2,121,190, the disclosures of which are incorporated herein by reference. The stacking means facilitate maintenance of several compartments 10 in the same location.

Figure 8:
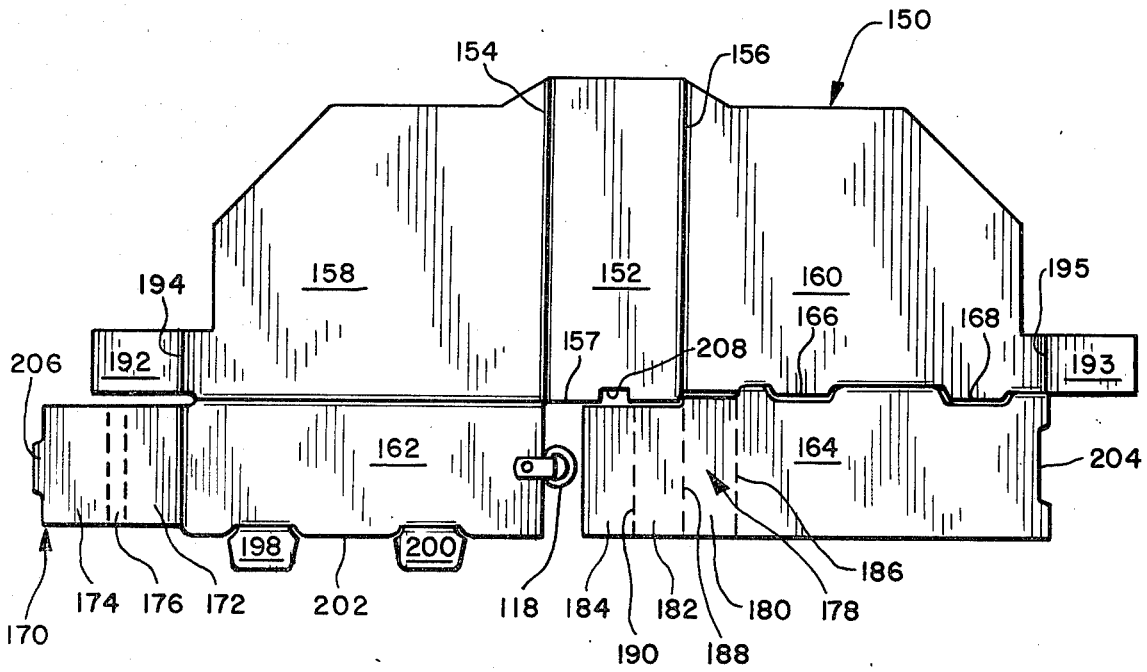
FIG. 8 is a top plan view of a blank for assembling a file tray of FIG. 2 embodying features of the present invention.

Referring now to FIG. 8, there is illustrated a single piece blank, designated generally by reference numeral 150, which blank 150 can be assembled into the tray 14*a* illustrated in detail in FIGS. 2 to 7. As was indicated above, the tray 14*a* can be completely assembled without the use of conventional securing means such as staples, bolts, adhesives or the like. As illustrated, the only component having some additional apparatus for securement is the optional ring 118, which could also be formed as an integral part of the tray 14*a*. The ring 118, however, is preferably constructed of a more rigid material than the tray 14*a*.

The blank 150 includes an end panel 152, hingedly connected along its longitudinal edges 154, 156 to a first side panel 158 and a second side panel 160 respectively. The first side panel 158 is hingedly connected to a first bottom panel 162 along a line which, if extended, would define a lower edge 157 the end panel of 152. The second side panel 160 is hingedly connected to a second bottom panel 164 and includes a first and a second slot 166, 168 along the hinged connection to side panel 160. A first flap 170 is hingedly connected to said first bottom panel 162, opposite said second bottom panel 164, and includes two longitudinal hinge connections, defining a first and a second portion 172, 174, and a center strip 176. A second flap 178 includes a first, a second, and a third portion 180, 182, 184, which are connected to the second bottom lower panel 164, and to each other, by hinge connections at their adjacent edges 186, 188, 190. Extending from the first and second side panels 158, 160 are, respectively, a first and a second side tab 192, 193, hingedly connected at longitudinal side panel edges 194, 195 opposite the center panel 152. A first and second bottom tabs 198, 200 extend along an edge 202 of the first bottom panel 162, opposite its hinged connection to the side panel 158. When the blank 150 is constructed of a foldable material, such as corrugated fiberboard, the hinge connections described above may be longitudinal or transverse score lines.

The blank 150 may also include components for assembling preferred features of the tray 14*a*. The first and second side panels 158, 160 may have cutaway edges opposite said first and second bottom panels 162, 164 respectively. The second bottom panel 164 has a recess 204 opposite the second flap 178 to receive a first flap tab 206, which is an extension of the second portion 174 of the first flap 170. A pull or ring 118 may also be secured to the first bottom panel 162 and an end panel recess 208 is provided to receive the ring 118.

The blank 150, as illustrated, may be assembled into tray 14*a* by: folding the side panels 158, 160 toward each other, over the end panel 152, to form the second and first sides 32, 30 respectively of the tray 14*a*; folding the second bottom panel 164 toward its adjacent side panel 160 to form the upper layer 40 of the bottom wall 38; and folding the first bottom panel 162 toward the second bottom panel 164 and inserting the bottom tabs 198, 200 into the second bottom panel slits 166, 168 to form the lower layer 42 of the bottom wall 38. The first flap 170 may be positioned against the second bottom panel 164 or, alternately, be folded about the side tabs 192, 193 to form the restraining means. The second flap 178 can be positioned against the first bottom panel 162 and end panel 152 or, alternately, folded into a step to form the positioning means.

The blank 150, as described above, can be assembled into a tray 14*a* without the use of any tools in a small fraction of a minute. An average person can assemble the tray 14*a* from the blank 150 within five to ten seconds, with ease. The tray 14*a* can be disassembled into the blank 150 within a similar period of time.

Referring now to FIGS. 9 to 11, there is illustrated a tray, designated generally by the reference numeral 14*b*. The tray 14*b* includes the more preferred restraining means, including a flap 230 with an end or first panel 232 which fits together, in a jig-saw like manner, with the upper layer 242 of the bottom wall 238, to lock the flap 230 in a standing position. The end panel 232 preferably has a trapezoidal configuration and the bottom wall's upper layer 242 is cutaway to form a recess in the bottom wall 238 of substantially the same configuration. The upper layer 242 may also be cutaway further to provide a notch 244 which facilitates grasping the end panel 230, when fitting together with the upper layer 242. When the tray 14*b* is positioned for open storage, the end panel 232 overlies the bottom wall's upper layer 242, as does the rest of the flap 230.

The other features of the file 14*b* are the same as described above for the tray 14*a*, and will not be discussed further.

In FIG. 12 there is illustrated a blank 350 from which the tray 14*b*, illustrated in FIGS. 9 to 11, may be formed. The blank 350 includes a first bottom panel 360, which is recessed at its outward end so as to be complementary to an end portion 370 of a second bottom panel 372. Other features of this blank 350 are the same as described above for the blank 150, illustrated in FIG. 8, and will not be discussed further.

The above described particular embodiments of the invention, methods of operation, materials utilize, and combinations of elements can vary without changing the spirit of the invention, as particularly defined in the following claims.

I claim:

1. A compartment for storing side-tabbed files or the like, comprising:

a cabinet including at least one open side;

at least one file tray including a bottom wall, two opposed side walls, an end wall, an open-end opposite said end wall, means for restraining stored files from movement out of said open-end, including a first flap formed integrally with said file tray, which first flap is adjustable between a functional upright position and a nonfunctional position overlying a wall of said file tray, and means for positioning stored files partially outward said open-end, including a second flap formed integrally with said file tray, which second flap is adjustable between a functional position forming a step adjacent said end wall and a nonfunctional position overlying at least one wall of said file tray; and wherein said cabinet receives said file tray through said open side.

2. The compartment of claim 1 wherein said opening of said cabinet is of substantially the same height as said end wall of each said trays and is substantially of the same width as a cummulative of the widths of said end walls of said trays.

3. The compartment of claim 1 wherein said first flap is disposed across a portion of said open-end when in said functional position.

4. The compartment of claim 3 wherein said flap includes a first, second, and third hingedly interconnected panels, said first panel being secured to said bottom of said tray forward of said end wall, and said first panel being disposed overlying a portion of said bottom wall, and said second and third panels being disposed against said end wall of said tray when said step is in a nonfunctional position.

5. The compartment of claim 1 wherein said first flap includes an edge interconnected to the bottom of said tray and an opposed free edge which can be disposed in a non-functional position adjacent said bottom wall of said tray; and said restraining means further includes means for locking said first flap in an upright position.

6. The compartment of claim 5 wherein said locking means includes two opposed tabs extending from said side walls along their edges adjacent said open-end of said tray and a slot formed in the bottom wall of said tray adjacent said open-end for receiving at least a portion of said flap along its free edge and wherein said flap is hinged so as to fold about and sandwich said tabs.

7. The compartment of claim 5 wherein said locking means includes two opposed tabs extending from said side walls along their edges adjacent said open-end of said tray and said first flap is hinged so as to fold about and sandwich said tabs, said first flap including an end panel with recessed sides and said bottom wall including a recess which receives said end panel.

8. The compartment of claim 5 wherein at least one of said side walls are partially cutaway to expose a portion of a file stored within.

9. The compartment of claim 8 wherein said opposed side walls of said tray are cutaway about an area adjacent to the open-end of the tray from the top of the tray to the top edge of said flaps when in upright position.

10. The compartment of claim 9 wherein said opposed side walls are cutaway along a diagonal from the edge of said walls adjacent said open-end of said tray to a point on the top of said tray.

11. The compartment of claim 10 wherein said opposed side walls are cutaway at least along a portion of the top of said tray.

12. The compartment of claim 11 wherein the bottom wall of said tray includes a lower and upper layer and said first flap is an extension of said lower layer.

13. The compartment of claim 12 wherein said upper layer of said bottom wall extends from said open-end to a distance from said end wall and said second flap is an extension of said upper layer.

14. The compartment of claim 13 wherein said step is formed from said second flap when said first and third panels are positioned substantially perpendicular to said bottom wall, said second panel extends between said first and third panels a distance above said bottom wall and substantially parallel to said bottom wall, and said third panel abuts the end wall of the tray.

15. The compartment of claim 14 wherein said first panel has a width greater than said second and third panels.

16. The compartment of claim 15 further including means for pulling the tray positioned on the outer surface of said end wall of said tray.

17. The compartment of claim 1 wherein said tray is formed of corrugated fiberboard.

18. In a compartment for storing side-tabbed files or the like which includes a cabinet for receiving at least one file tray, a reversible tray for storage of files in both an open and a closed position comprising:

a bottom wall;

two opposed side walls;

an end wall;

an open-end opposite said end wall;

means for positioning stored files partially outward said open-end when stored open including a second flap formed integrally with said file tray, which second flap is adjustable between a functional position forming a step adjacent said end wall and a nonfunctional position overlying at least one wall of said file tray; and means for restraining stored files from movement out of said open-end when stored closed including a first flap formed integrally with said file tray, which first flap is adjustable between a functional upright position and a nonfunctional position overlying a wall of said file tray.

19. The tray of claim 18 wherein said end wall is of such dimensions for forming a dust barrier with said cabinet when stored closed.

20. The tray of claim 19 wherein said step is formed of a first, second, and third hingedly interconnected panels, said first panel being secured to said bottom of said tray and said first panel being disposed overlying a portion of said bottom wall and said second and third panels being disposed against said end wall of said tray when said step is in a nonfunctional position.

21. The tray of claim 20 wherein said step is in a functional position when said first and third panels are positioned substantially perpendicular to said bottom wall, and said second panel extends between said first and third panels a distance above said bottom wall, substantially parallel to said bottom wall.

22. The tray of claim 21 wherein said first flap includes a bottom edge interconnected to the bottom of said tray and an opposed free edge; and said restraining means further includes means for locking said flap in an upright position.

23. The tray of claim 22 wherein said locking means includes two opposed tabs extending from said side walls and a recess formed in the bottom wall of said tray adjacent said open-end for receiving a portion of said first flap and wherein said flap is hinged so as to fold about said tabs.

24. The tray of claim 23 wherein said recess receives a portion of said first flap along its free end.

25. The tray of claim 23 wherein said recess receives an end panel of said first flap.

26. The tray of claim 23 wherein at least one of said side walls are at least partially cutaway to expose a portion of a file stored within.

27. The compartment of claim 26 further including at least one stored file including a side tab wherein said first flap extends above the bottom edge of said side tab when in an upright position.

28. The tray of claim 27 wherein said opposed side walls of said tray are cutaway about an area adjacent to the open-end from the top of the tray to the top edge of said first flap when in an upright position.

29. The tray of claim 28 wherein said opposed side walls are cutaway along a diagonal from the edge of said walls adjacent said open-end to a point on the top edge of said tray.

30. The tray of claim 29 wherein said opposed side walls are cutaway at least along a portion of the top of said tray.

31. The tray of claim 30 wherein the bottom wall of said tray includes a lower and upper layer and said first flap is an extension of said lower layer.

32. The tray of claim 31 further including a pull means positioned on the outer surface of said end walls of said tray.

* * * * *

UNITED STATES PATENT AND TRADEMARK OFFICE

CERTIFICATE OF CORRECTION

PATENT NO. : 4,145,100

DATED : March 20, 1979

INVENTOR(S) : Gerald R. Klaus

It is certified that error appears in the above-identified patent and that said Letters Patent are hereby corrected as shown below:

Col. 4, line 9, delete "dge" and insert --edge-- therefor.

Col. 4, line 16, delete "trays" and insert --tray-- therefor.

Col. 4, line 22, delete "trays" and insert --tray-- therefor.

Col. 4, line 22, delete "include" and insert --includes-- therefor.

Col. 4, line 32, delete "trays" and insert --tray-- therefor.

Col. 5, line 5, delete "the" and insert --The-- therefor.

Col. 5, line 59, insert --.-- after nonfunctional.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*